US008668001B2

(12) United States Patent
Smart et al.

(10) Patent No.: US 8,668,001 B2
(45) Date of Patent: Mar. 11, 2014

(54) FOLDING PARTITIONS HAVING PROTECTED ACTUATION DEVICES AND RELATED METHODS

(75) Inventors: R. Scott Smart, Sandy, UT (US); E. Carl Goodman, Bountiful, UT (US)

(73) Assignee: Won-Door Corporation, Salt Lake City, UT (US)

( * ) Notice: Subject to any disclaimer, the term of this patent is extended or adjusted under 35 U.S.C. 154(b) by 361 days.

(21) Appl. No.: 12/767,400

(22) Filed: Apr. 26, 2010

(65) Prior Publication Data

US 2011/0259532 A1 Oct. 27, 2011

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***E05F 11/00*** | (2006.01) |
| ***E05F 13/00*** | (2006.01) |
| ***E05F 15/00*** | (2006.01) |
| ***E06B 3/12*** | (2006.01) |

(52) U.S. Cl.
USPC ..... 160/84.08; 160/188; 160/233

(58) Field of Classification Search
USPC ..... 160/84.08, 84.11, 199, 206, 218
See application file for complete search history.

(56) References Cited

U.S. PATENT DOCUMENTS

| | | | | |
|---|---|---|---|---|
| 3,509,934 | A | 5/1970 | Smart | |
| 3,807,480 | A | 4/1974 | Smart | |
| 4,924,929 | A | 5/1990 | Johnson et al. | |
| 5,638,639 | A | 6/1997 | Goodman et al. | |
| 6,662,848 | B2 | 12/2003 | Goodman et al. | |
| 2008/0105389 | A1 * | 5/2008 | Goodman et al. | 160/203 |
| 2008/0244991 | A1 * | 10/2008 | Coleman et al. | 52/71 |
| 2009/0096622 | A1 * | 4/2009 | Banta et al. | 340/635 |

* cited by examiner

*Primary Examiner* — Katherine Mitchell
*Assistant Examiner* — Jeremy Ramsey
(74) *Attorney, Agent, or Firm* — TraskBritt

(57) ABSTRACT

Movable partitions and systems are provided and may include accordion-style folding doors or partitions having sheets of folding panels. In one embodiment, the movable partition may include at least two hinge panels indirectly connecting adjacent folding panels. The hinge panels may have laterally spaced apart the adjacent folding panels from one another such that a compartment is formed upon retraction or folding of the sheets of folding panels. One or more control devices, such as an actuation device or a display panel, may be mounted on at least one of the hinge panels, or on the panel disposed between hinge panels such that, when the movable partition is in a retracted or folded state, the actuation devices are housed within the compartment.

21 Claims, 7 Drawing Sheets

FOLDING PARTITIONS HAVING PROTECTED ACTUATION DEVICES AND RELATED METHODS

TECHNICAL FIELD

Embodiments of the invention are directed to the field of partitions used for partitioning space, as sound barriers, as fire barriers, security barriers, and for various other applications.

BACKGROUND OF THE INVENTION

Accordion or folding-type movable partitions are utilized in numerous situations and environments for a variety of purposes. Such a movable partition may include laterally adjacent sheets, each including a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other specified reason, the partition may be extended along an overhead track, which is often located above the partition in a header assembly, until the partition extends a desired distance across the room.

Automatic extension and retraction of the movable partition may be accomplished through the use of a motor located in a pocket formed in a wall of a building in which the movable partition is stored when in a retracted or folded state. The motor, which remains fixed in place within the pocket, may be used to drive extension and retraction of the movable partition. A motor for automatically extending and retracting a movable partition may also be mounted within the movable partition itself, such that the motor travels with the movable partition as the movable partition is extended and retracted using the motor.

The movable partitions may also include various actuation devices or switches to assist in control thereof. Such actuation devices or switches may be electrically connected to control circuitry for the partition. For example, a button switch may be provided on a movable partition, and the button switch may be configured such that, if the button switch is depressed while the movable partition is automatically closing (e.g., in the event of a fire), the movable partition will momentarily cease movement before attempting to close again, or the button may be configured to cause the direction of movement of the partition to reverse (e.g., open) for a predetermined time or distance before attempting to automatically close again.

FIG. 1A illustrates an example of a movable partition system 100 that includes actuation devices. The movable partition system 100 is an automatic movable partition system, in that the system 100 includes a movable partition 102 that may be automatically extended, automatically retracted, or both automatically extended and automatically retracted. The movable partition system 100 may comprise a motor (not shown) for driving movement of the movable partition 102 between the extended and retracted states. The movable partition 102 may be an accordion-type door that includes laterally spaced sheets of panels 104. A lead post 108 may be attached to a leading end 109 of the one or more sheets of panels 104. At least some of the panels 104 are indirectly connected to one or more adjacent panels 104 in the sheet of panels 104 by way of hinge members 106, which are disposed therebetween. The movable partition 102 may further include one or more actuation devices, such as a rocker switch 122 and a button switch 124, which may be configured to control movement of the movable partition 102.

As shown in FIG. 1B, a lateral end of a first panel 104A may be indirectly connected to a first lateral end of a second panel 104B by the hinge member 106. The panels 104 in each of the laterally spaced sheets 103A and 103B are connected to one another in such a manner as to allow the panels to fold back-and-forth relative to one another in accordion fashion, which allows the movable partition 102 to collapse as the movable partition 102 is retracted (i.e., opened). Thus, the movable partition 102 may be compactly stored in a pocket 110 formed in a wall 112 (see also FIG. 1A) of a structure when the movable partition 102 is in the retracted state (i.e., collapsed and folded).

The rocker switch 122 may be mounted on the lead post 108 of the movable partition 102 such that it is readily accessible to a person when the movable partition 102 is in either the retracted state or an extended state. The rocker switch 122 may comprise a three position switch. In a neutral, middle position, the rocker switch 122 will not cause any movement of the movable partition 102. When the rocker switch 122 is rocked to one side of the neutral, middle position, the rocker switch 122 may cause (in conjunction with the motor and other components of the system) the movable partition 102 to extend (i.e., close). Similarly, when the rocker switch 122 is rocked to the opposite side of the neutral, middle position, the rocker switch 122 may cause the movable partition 102 to retract (i.e., open). Often, the rocker switch 122 may comprise a key lock device, such that the rocker switch 122 may only be operated when with the key lock has been unlocked using a key. If the key lock is not in the unlocked position, the rocker switch 122 may be locked in the neutral, middle position such that the movable partition 102 may not be opened or closed.

When the movable partition 102 is used as a safety door or a fire door, the movable partition 102 may be configured to automatically close upon detection of a fire (i.e., upon actuation of a fire alarm). The button switch 124 may be employed as what is often referred to in the art as "panic hardware." In the event that the movable partition 102 is automatically closing (or has automatically closed) and a person seeks to temporarily stop the movable partition 102 from closing (or to momentarily open the movable partition 102), actuation of the button switch 124 may cause the movable partition 102 to open if it is closed, or to stop while it is closing, thereby enabling an individual located on one side of the movable partition 102 to pass from one side of the movable partition 102 to the other.

In the closed position, the panels 104 of the movable partition 102 are in close proximity with one another to reduce the longitudinal depth of the movable partition 102 for compact storage in the pocket 110. The button switch 124 may be disposed or mounted on a hinge member 106 of the movable partition 102 to provide access to the button switch 124 during operation of the movable partition 102.

The button switch 124 (and the rocker switch 122) are positioned on surfaces of the movable partition 102 near the leading edge 109 such that they are susceptible to damage or destruction during operation and storage of the movable partition 102. When the movable partition 102 is moved in and out of the storage pocket 110 between the extended and retracted states, elements of the button switch 124 may catch on edges of the adjacent walls defining the pocket 110, and may be bent or detached from the movable partition 102.

BRIEF SUMMARY OF THE INVENTION

In accordance with one aspect of the present disclosure, a movable partition system is provided that includes a folding section and at least one actuation device. The folding section may include a plurality of interconnected panels and at least two hinge panels indirectly interconnecting and spacing apart adjacent panels of the plurality. The adjacent panels coupled by the plurality of hinge panels are spaced from each other a greater longitudinal distance than remaining interconnected panels of the plurality. The at least one actuation device may be disposed on one of the adjacent panels indirectly interconnected and spaced apart by the at least two hinge panels or on one of the hinge panels.

In accordance with another aspect of the present invention, a movable partition system is provided that includes a movable partition and at least one actuation device. The movable partition may include a first partition and a second partition. Each of the first and second partitions may be configured to move between an extended state and a retracted state and may include a first panel, a second panel adjacent the first panel, a third panel adjacent the second panel, a first hinge panel coupling the first panel and the second panel, the first hinge panel having a width sufficient to define a compartment between the first and second panels in the retracted state and a second hinge panel coupling the second panel and the third panel, the first hinge panel having a width sufficient to form a second compartment between the first and second panels. The at least one actuation device may be mounted on at least one of the second panel, the first hinge panel and the second hinge panel of at least one of the first partition and the second partition. For example, the at least one actuation device may include a button switch mounted on a second panel such that a portion of the button switch is accessible when the first and second partitions are in the extended state and is housed within a compartment when the first and second partitions are in the retracted state.

In accordance with another aspect of the present disclosure, a movable partition system is provided that includes a sheet of panels movably connected to one another by a plurality of hinge connectors, the sheet configured to extend to an extended state and to fold in an accordion fashion to a retracted state. The sheet of panels may include a plurality of hinge panels, each having a width greater than a width of the hinge connectors and coupling adjacent panels of the sheet of panels, each hinge panel and the adjacent panels coupled thereto defining a compartment in the retracted state. At least one actuation device may be mounted on at least one of the hinge panels of the plurality and the adjacent panels coupled thereto. The actuation devices may include at least one of a button switch and a rocker switch and may be disposed within the compartment when the door is in the retracted state.

In accordance with another aspect of the present disclosure, a method of providing access to at least one actuation device of a movable partition is provided. The method may include forming a movable partition comprising a sheet of panels configured to extend to an extended state and to fold in an accordion fashion to a retracted state, the panels of the sheet coupled to one another at lateral ends thereof, disposing at least two hinge panels in between adjacent panels of the sheet, the at least two hinge panels indirectly coupling the adjacent panels and disposing a control device on at least one of the at least two hinge panels and the adjacent panels coupled by the at least two hinge panels, the at least two hinge panels providing lateral spacing between panels of the sheet to form adjacent compartments in the retracted state.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Illustrations presented herein are not meant to be actual views of any particular movable partition system, movable partition, or component thereof, but are merely representations that are employed to describe embodiments of the present invention. Additionally, elements common between figures may retain the same numerical designation.

Figure 1A:
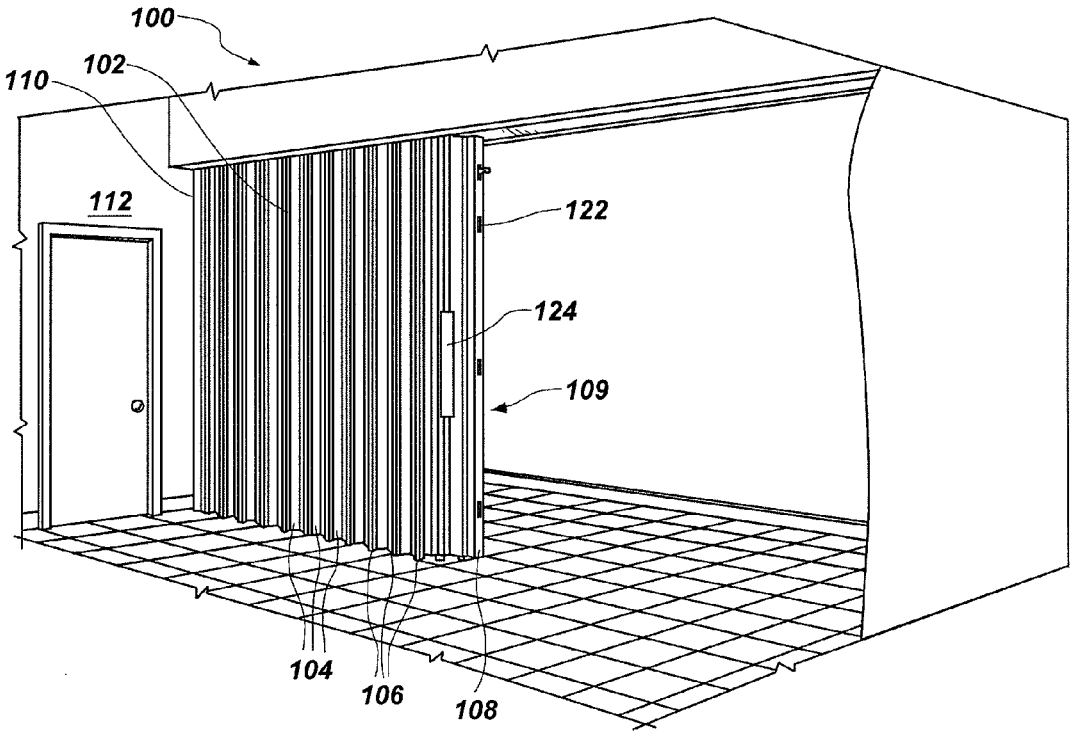
FIG. 1A (PRIOR ART)
FIG. 1A is a perspective view of a conventional movable partition including actuation devices.
Figure 1B:
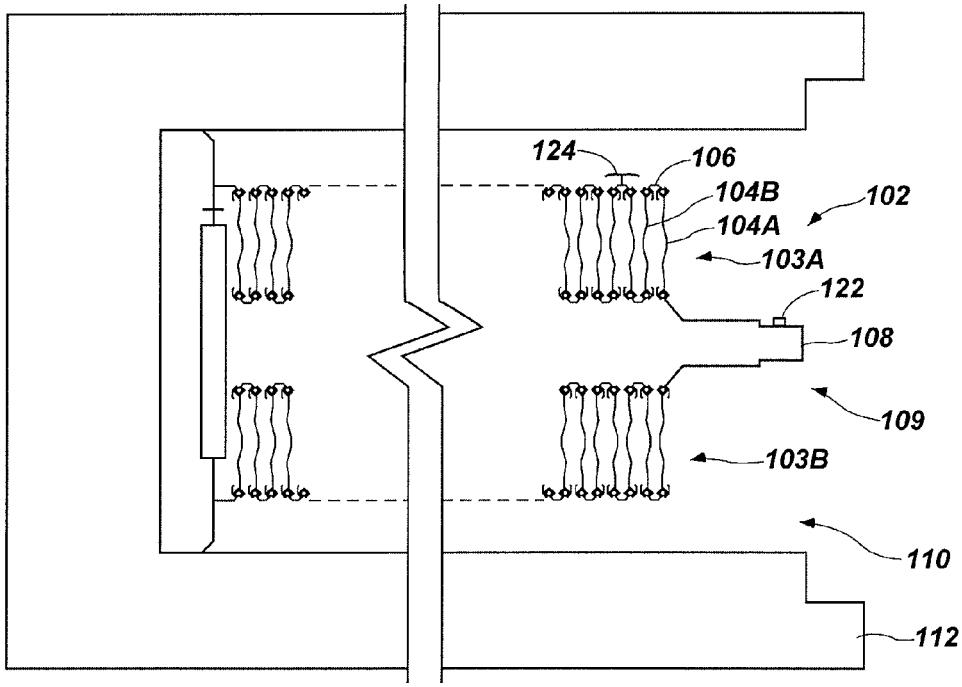
FIG. 1B (PRIOR ART)
FIG. 1B is a top plan view of the conventional movable partition system shown in FIG. 1A in a folded or collapsed state.
Figure 2:
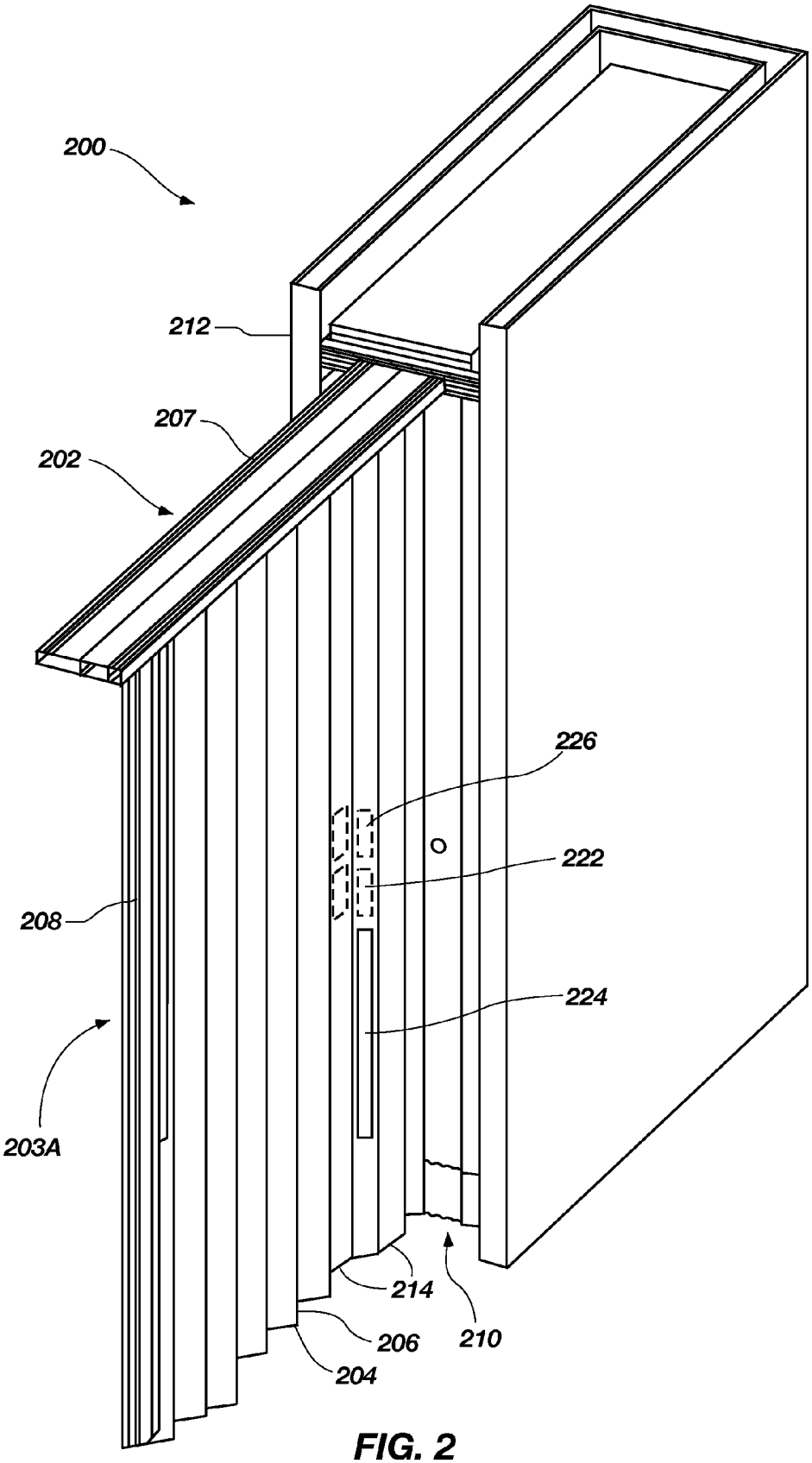
FIG. 2 is a perspective partial view of a system including a movable partition system according to at least one embodiment of the present disclosure.

Referring to FIG. 2, a system 200 is shown, which may also be referred to as a movable partition system 200. The system 200 includes a movable partition 202 in the form of an accordion-type door. The movable partition 202 may be used as a barrier (e.g., sound barrier, security barrier, fire barrier, etc.). As used herein, the term "sound barrier" means any material, structure, or element configured to provide a barrier to sound waves or configured to retard or resist the travel of sound waves between two or more areas. The term "fire barrier" or "fire resistant" means any material, structure, or element configured to provide a barrier to fire, smoke, and/or heat or configured to retard or resist the deleterious effects of fire, smoke, and/or heat for a certain period of time. In other embodiments, the movable partition 202 may be used, for example, to subdivide a relatively larger space into relatively smaller spaces (e.g., rooms or areas). The movable partition 202 may be an accordion-type door that includes laterally spaced sheets, each including a plurality of panels 204 that are movably connected to one another with hinge connectors 206 or other hinge-like members to form a pleated (i.e., plicated) structure. For simplicity and clarity of illustration, a single sheet 203A of the movable partition 202 is shown in several of the figures. Each of the hinge connectors 206 (FIGS. 3B and 3C) forms a joint between adjacent panels 204 enabling the panels 204 to fold in an accordion-like manner from a fully extended state to a fully collapsed state. The movable partition 202 is engaged with (e.g., suspended from) an overhead track 207, along which the movable partition 202 moves as the movable partition 202 is extended (i.e., closed) and retracted (i.e., opened). The hinged connection of the panels 204 allows the movable partition 202 to be compactly stored in a pocket 210 formed in a wall 212 of a structure when in the retracted or collapsed state.

To deploy the movable partition 202 to an extended position, the movable partition 202 is moved along the overhead track 207. A leading edge of the movable partition 202 may include a lead post 208 configured to engage with a door jamb or another post, which may be provided in another wall (not shown) of the structure to which the movable partition 202 may move to the extended state. While the embodiment of the movable partition 202 shown and described with reference to FIG. 2 contains a single accordion-type door, additional embodiments of the present invention may include multiple doors. For example, a partition may include two doors (e.g., accordion-type doors) configured to extend across a space and join together to partition a space.

The system 200 may further include two or more hinge panels 214, each of which is disposed between two adjacent panels of the movable partition 202. As will be described, the hinge panels 214 may have a width greater than a width of the hinge connectors 206 to provide additional spacing between selected panels 204.

The system 200 may also include one or more actuation devices, such as a rocker switch 222, a button switch 224 (e.g., a kick plate switch) and, optionally, a display panel 226, as described in further detail below. The rocker switch 222 and the display panel 226 may be mounted on one of the hinge panels 214 and/or on one of the panels 204 that is indirectly coupled and spaced apart from adjacent panels 204 by one or more of the hinge panels 214. The button switch 224 may be mounted on the one of the panels 204 that is indirectly coupled and spaced apart from adjacent panels 204 by one or more of the hinge panels 214.

Figure 3A:
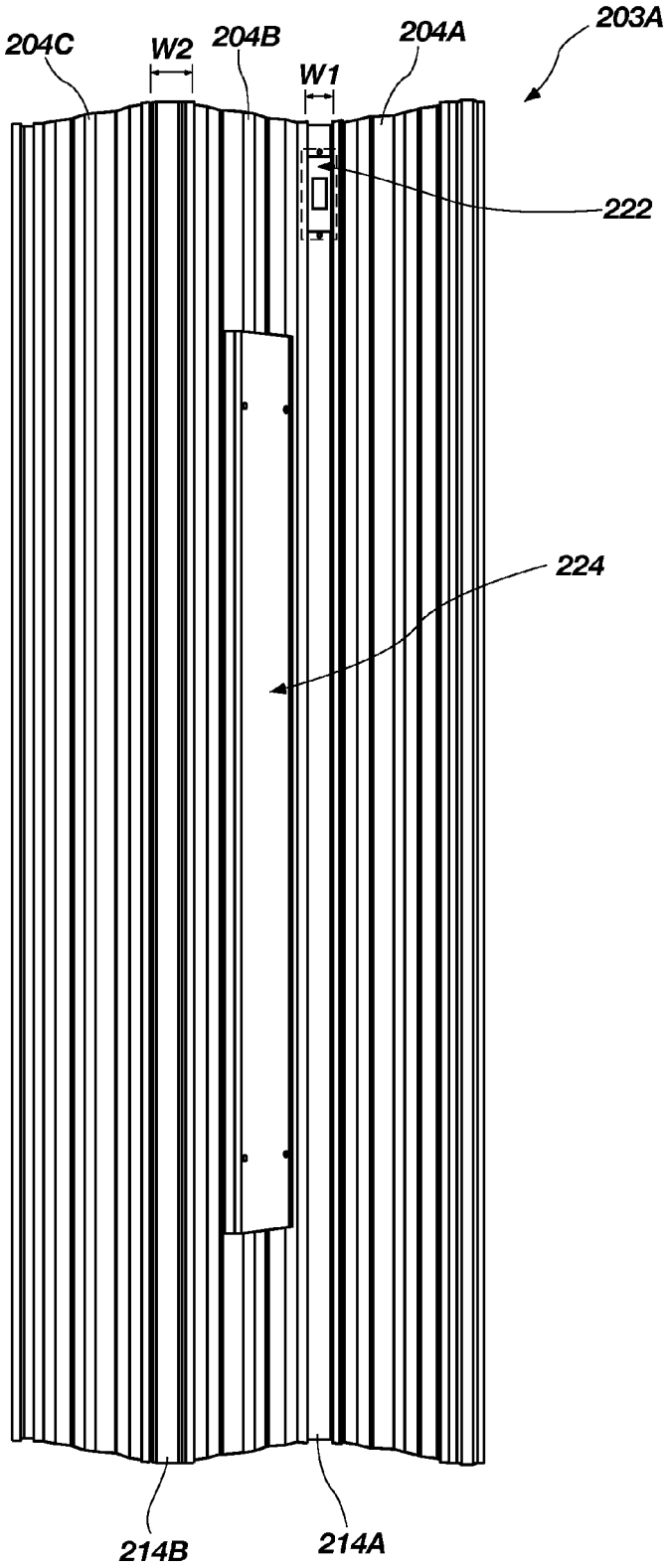
FIG. 3A is a perspective view of portion of a movable partition system according to at least one embodiment of the present disclosure.
Figure 3B:
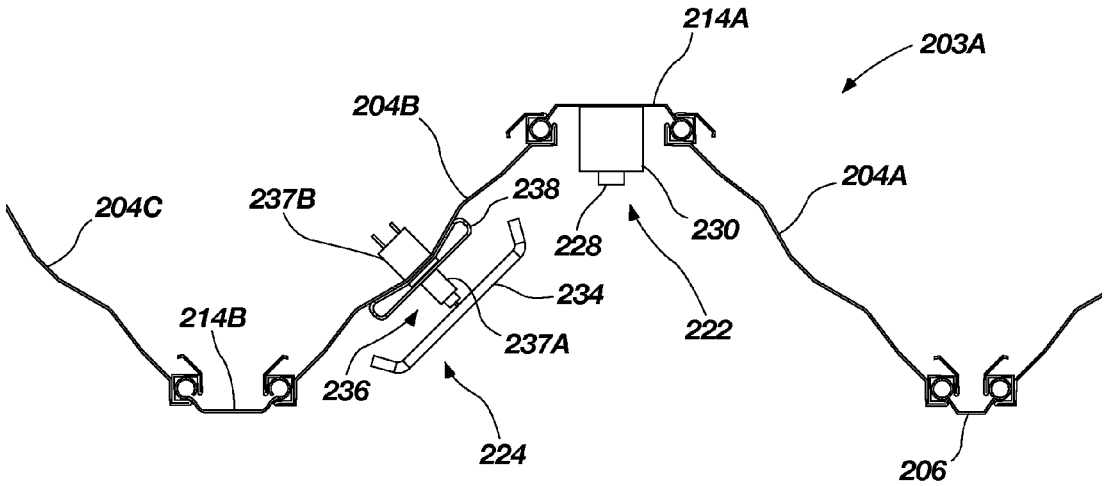
FIGS. 3B and 3C are top plan views of a portion of the movable partition system shown in FIG. 3A in partially extended and retracted states, respectively.
Figure 3C:
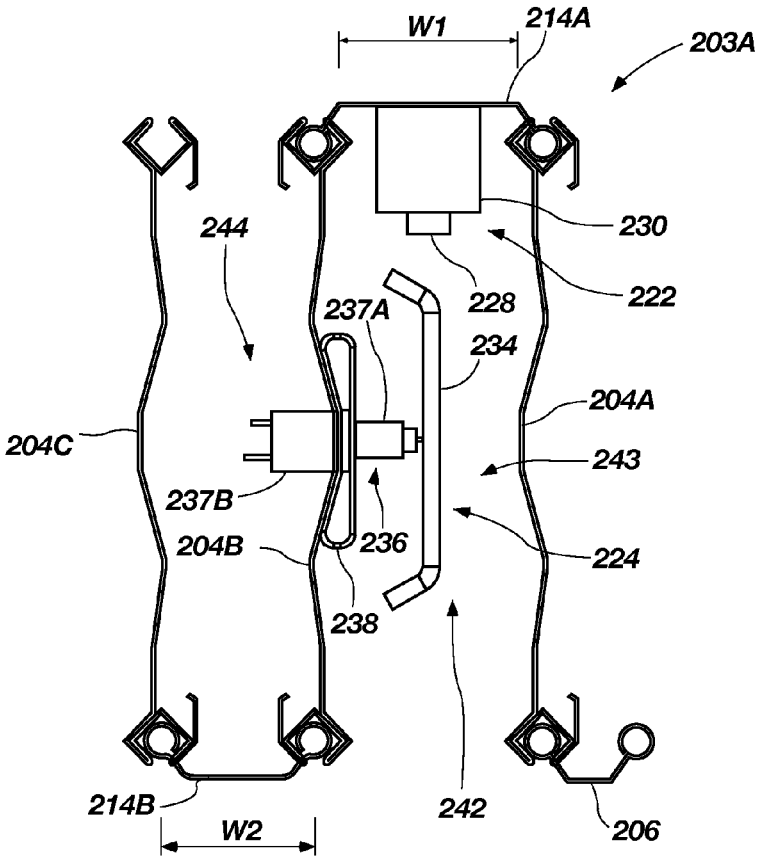

FIGS. 3A through 3C illustrate a portion of an embodiment of the sheet 203A of panels 204 of the movable partition 202 shown in FIG. 2. The display panel 226 has been omitted from FIGS. 3A through 3C for simplicity and clarity of illustration. Referring to FIG. 3A, the panels 204A and 204B of the sheet 203A may be coupled to one another by a first hinge panel 214A and the panels 204B and 204C coupled by a second hinge panel 214B. For example, a lateral end of a first panel 204A may be indirectly coupled to a lateral end of a second panel 204B by the hinge panel 214A and a lateral end of a second panel 204B opposite that coupled to the first hinge panel 214A may be indirectly coupled to a lateral end of a third panel 204C by the second hinge panel 214B. The hinge panels 214A and 214B may each be structures formed to have a configuration generally similar to the hinge connectors 206 while having greater widths W1 and W2, respectively, than the hinge connectors 206 so that adjacent panels 204A and 204B coupled with the hinge panel 214A and adjacent panels 204B and 204C coupled with the hinge panel 214B are spaced apart from each other a greater longitudinal distance as compared to adjacent panels 204 that are coupled with the hinge connectors 206. For example, the hinge connectors 206 may have a width of about 9 millimeters. The widths W1 and W2 of the hinge panels 214A and 214B may be between about 15 millimeters and about 45 millimeters, and more particularly, between about 23 millimeters and about 43 millimeters. The widths W1 and W2 of the hinge panels 214A and 214B may be less than or equal to a width of the panels 204A, 204B and 204C. For example, the widths W1 and W2 of the hinge panels 214A and 214B may be between about one-eighth (⅛) to about three-quarters (¾) the width of the panels 204A, 204B and 204C and, more particularly, between about one-quarter (¼) to about one-half (½) the width of the panels 204A, 204B and 204C. In some embodiments, the width W1 of the hinge panel 214A may be substantially equal to the width W2 of the hinge panel 214B. In other embodiments, the width W1 of the hinge panel 214A may be between about one-eighth (⅛) to about three-quarters (¾) the width W2 of the hinge panel 214B. In further embodiments, the width W2 of the hinge panel 214B may be between about one-eighth (⅛) to about three-quarters (¾) the width W1 of the hinge panel 214A. The hinge panels 214A and 214B provide movable attachment between panels 204A, 204B and 204C while also providing increased longitudinal spacing between these panels in the direction along the path defined by the track (FIG. 2), relative to the longitudinal spacing between panels 204 connected by hinges 206.

Actuation devices, such as the rocker switch 222 and the button switch 224, may be mounted on the panel 204B that is directly coupled to each of the hinge panels 214A and 214B. Alternatively, the actuation devices may be mounted on one or more of the hinge panels 214A and 214B. The hinge panels 214A and 214B provide lateral spacing between the panel 204B and the panels 204A and 204C of the sheet 203A, such that the actuation devices (i.e., rocker switch 222 and button switch 224) do not hinder movement of the sheet 203A as the movable partition 202 (FIG. 2) is moved between extended and retracted states. Lateral spacing between the panels 204 on which the actuation devices are disposed also provides space for the actuation devices, thus preventing damage or destruction of the actuation devices during operation or storage of the movable partition 202, as will be further described.

FIGS. 3B and 3C are top plan views of the portion of the sheet 203A of the movable partition 202 (FIG. 2) shown in FIG. 3A. The rocker switch 222 may include a switching device 228 and a casing 230 in which wiring for operation of the rocker switch 222 may be enclosed. The casing 230 of the rocker switch 222 may be mounted on an outwardly facing surface of the hinge panel 214 (FIG.2) of the movable partition 202 so that the switching device 228 may be accessed by an individual. The motor may be actuated by the rocker switch 222 and caused to extend or retract the movable partition 202. The rocker switch 222 may be used to reset the motor or to position the movable partition 202 as desired. For example, the rocker switch 222 may be electrically coupled to control circuitry (not shown) of the movable partition 202 such that pressing an upper portion of the rocker switch 222 may cause the movable partition 202 to close while pressing a lower portion of the rocker switch 222 may cause the movable partition 202 to open. As shown in FIG. 3B, the hinge panel 214A to which the rocker switch 222 and casing 230 are mounted may be configured to be located on an inner side of the sheet 203A when the sheet 203A is in the retracted position.

The button switch 224 may be mounted on the panel 204B, which is spaced apart from and indirectly coupled to the adjacent panels 204A and 204C by respective hinge panels 214A and 214B. The button switch 224 may include a plate 234 and a button 236, which includes a biasing portion 237A and a control portion 237B. The plate 234 may be mounted for movement toward or away from the panel 204B on mounting plate 238, which is spaced from and secured to the panel 204B by fasteners (not shown), such as screws or pins. The button switch 224 may be mounted on the panel 204B such that the plate 234 of the button switch 224 and the biasing portion 237A of the button 236 protrude from an outwardly facing surface of the sheet 203A where they may be readily accessed by an individual. The control portion 237B of the button switch 224 may be disposed on a backside of the panel 204B so that is it positioned between laterally adjacent sheets 203A and 203B (FIG. 2) and is not readily accessible from the exterior of the movable partition 202. The plate 234 may be secured to a top portion of the mounting plate 234 by a hanger (not shown), which maybe integrally formed with the plate 234. The plate 234 may also be secured to a lower portion of the mounting plate 238 by a conventional fastener (not shown), such as a screw or pin.

The button switch 224 may be biased away from the door by springs (not shown) and the button 236. For example, during operation of the movable partition 202, a pressure may be applied to the plate 234 so that it moves toward the mounting plate 238 causing the button 236 to be depressed. The button 236 may be connected to the control circuitry of the movable partition 202 such that depression of the button 236 causes the movable partition 202 to open a predetermined distance for a predetermined amount of time to allow the person operating the button switch 224 to pass from one side of the movable partition 202 to another. When the pressure is released from the plate 234 after being pushed toward the mounting plate 238, springs force the plate 234 away from the mounting plate 238.

The display panel 226 (FIG. 2) may include, for example, a liquid crystal display (LCD) panel, and may display information related to the status of the movable partition 202, such as the positioning thereof.

FIG. 3B shows the sheet 203A of the movable partition 202 in an at least partially extended state wherein the panels 204A, 204B and 204C are in a generally extended configuration, the panels 204A, 204B and 204C spaced apart and coupled by the hinge panels 214A and 214B, respectively. In the at least partially extended state, the plate 234 of the button switch 224 and the switching device 228 of the rocker switch 222 are exposed on an outwardly facing surface of the sheet 203A. Thus, the button switch 224 disposed on the panel 204B and the rocker switch 222 disposed on the hinge panel 214A may be readily accessed by an individual located on one side of the movable partition 202 to cause the movable partition 202 to open if it is closed, or to stop while it is closing, providing access through the barrier formed by the movable partition 202.

FIG. 3C shows the sheet 203A of the movable partition 202 in a retracted or folded state wherein panels 204A, 204B and 204C are spaced apart by a predetermined distance by the hinge panels 214A and 214B, respectively forming a first compartment 242 and a second compartment 244. The compartment 242 may be defined on two sides by the panels 204A and 204B and on a closed end by the hinge panel 214A. The compartment 244 may be defined on two sides by the panels 204B and 204C and on a closed end by hinge panel 214B. Each of the compartments 242 and 244 includes an opening opposite the respective hinge panels 214A and 214B defining the closed end that provides access to actuation devices, such as the rocker switch 222 and the button switch 224. The panels 204A, 204B and 204C may be spaced apart and positioned substantially parallel to one another. The hinge panels 214A and 214B may be generally horizontally aligned with one another and may be positioned substantially perpendicular to the panels 204A, 204B and 204C.

Actuation devices, such as the rocker switch 222, the button switch 234 and the display panel 226 (FIG. 2) may be enclosed within the compartments 242 and 244 while the sheet 203A of the movable partition 202 is in the at least partially retracted or fully retracted state. A width of the compartment 242 may be substantially equal to the width W1 of the hinge panel 214A and a width of the compartment 244 may be substantially equal to the width W2 of the hinge panel 214B. The width of the compartments 242 and 244 may be sufficient to house components of the rocker switch 222, the button switch 224 and the display panel 226. In some embodiments, the width of the compartment 242 may be sufficient to provide a gap 243 between the plate 234 of the button switch 224 and the panel 204A, the gap 243 providing access to the switching device 228 of the rocker switch 222. The gap 243 may have a width sufficient to enable the display panel 226 to be easily viewed while the sheet 203A is retracted. Additionally, the plate 234 of the button switch 224 may abut or be directly adjacent the panel 204A and the rocker switch 222 may be mounted at a position above the button switch 224, as shown in FIG. 3A, such that the opening of the compartment 242 provides access to the rocker switch 222 and the display panel 226. A width W2 of the compartment 244 may be sufficient to house the control portion 237B of the button switch 224.

The compartments 242 and 244 provide space between the panels 204A, 204B and 204C for actuation devices, such as the button switch 224 and the rocker switch 222, when the sheet 203A of the movable partition 202 is in the retracted or at least partially retracted position. By housing the actuation devices, such as the rocker switch 222, the button switch 224 and the display panel (not shown) within the compartments 242 and 244, the actuation devices may be protected from damage or destruction during retraction, extension, and storage of the movable partition 202. The plate 234, the mounting plate 238, and a biasing portion 237A of the button 236 of the button switch 224 are housed within the compartment 242, and a control portion 237B of the button 236 is housed within the compartment 244. Additionally, since the actuation devices are housed within the compartments 242 and 244 when the sheet 203A of the movable partition 202 is in the retracted state, the actuation devices are hidden from view and are less susceptible to being tampered with or vandalized.

Figure 4A:
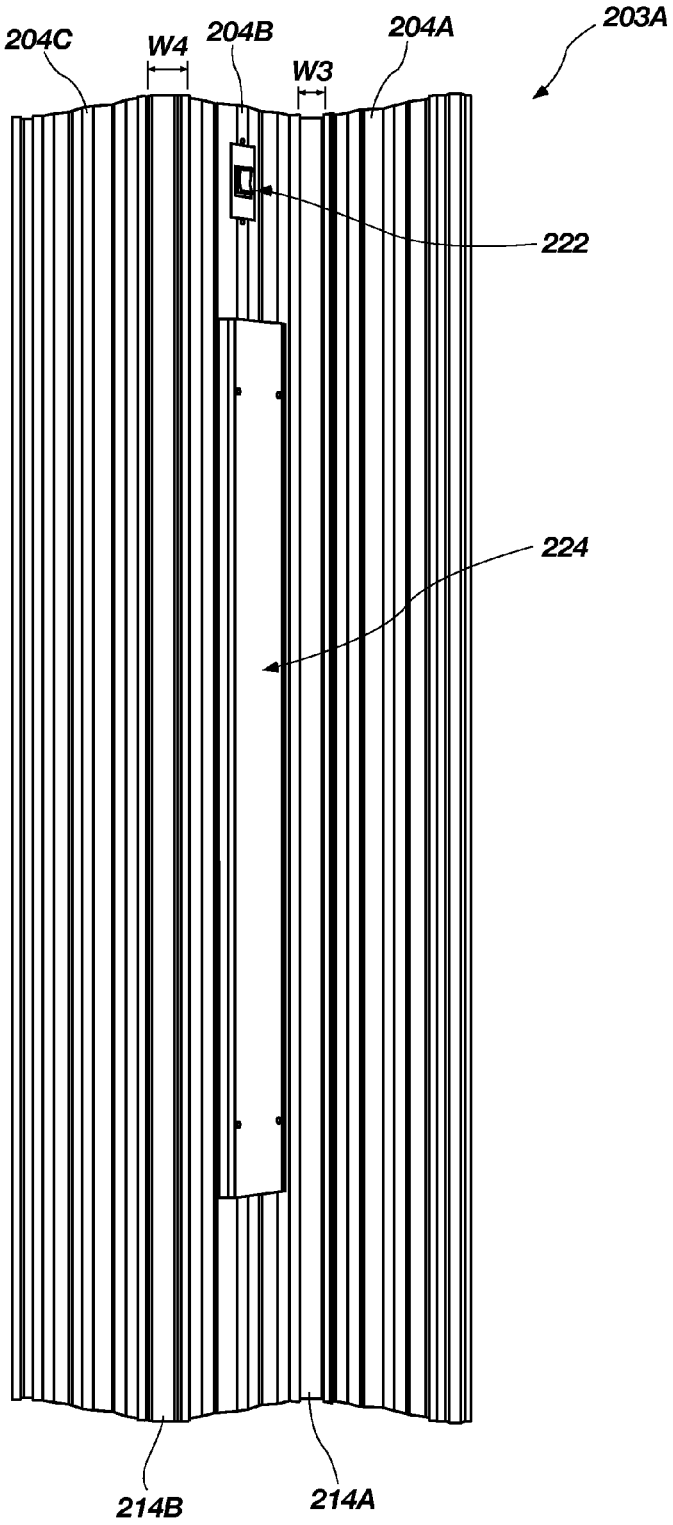
FIG. 4A is a perspective view of portion of a movable partition system according to at least one embodiment of the present disclosure.
Figure 4B:
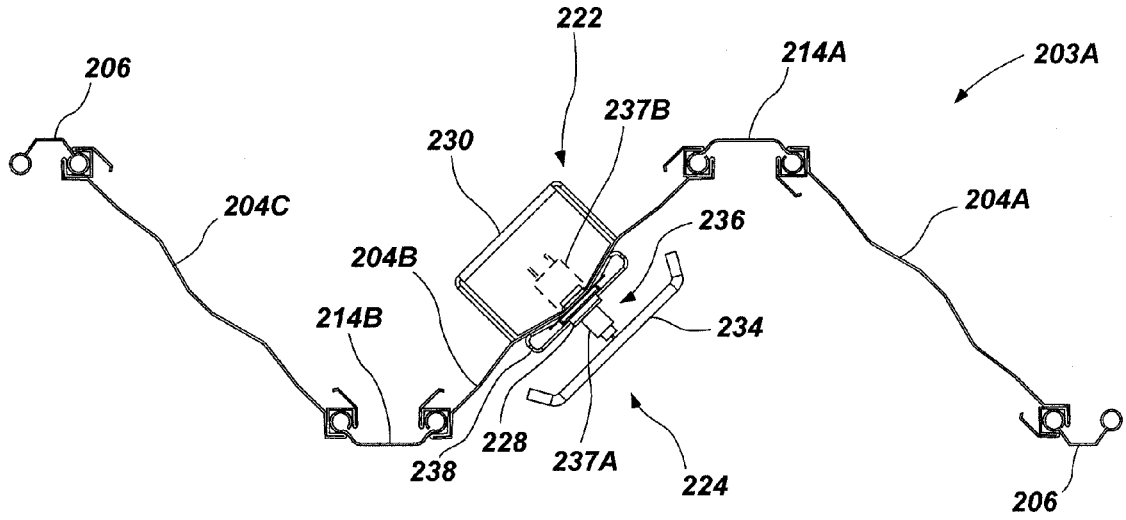
FIGS. 4B and 4C are top plan views of a portion of the movable partition system shown in FIG. 4A.
Figure 4C:
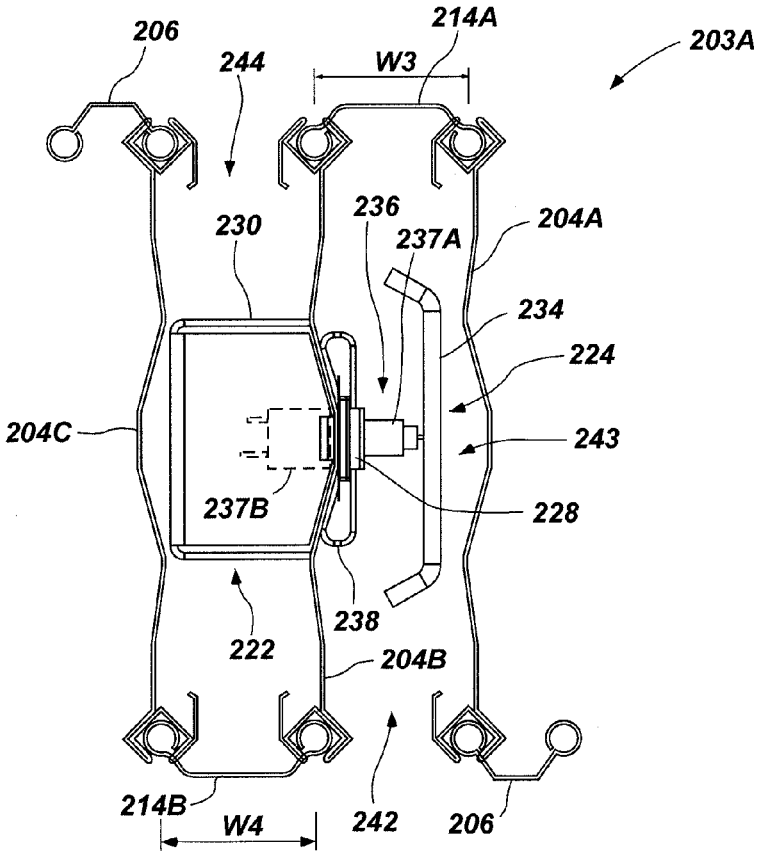

FIGS. 4A through 4C illustrate another embodiment of the sheet 203A of panels 204 of the movable partition 202 shown in FIG. 2. For simplicity and clarity of illustration, the display panel 226 has been omitted from FIGS. 4A through 4C. Referring to FIG. 4A, panels 204A and 204B of sheet 203A of panels may be indirectly coupled to one another by a first hinge panel 214A, and the panels 204B and 204C may be indirectly coupled by a second hinge panel 214B. A lateral end of a first panel 204A may be indirectly coupled to a lateral end of a second panel 204B by the hinge panel 214A and a lateral end of a second panel 204B opposite that coupled to the first hinge panel 214A may be indirectly coupled to a lateral end of a third panel 204C by the second hinge panel 214B. The hinge panels 214A and 214B may each be structures formed to have a configuration generally similar to the hinge connectors 206 while having a greater width W3 and W4, respectively, than the hinge connectors 206 so that adjacent panels 204A and 204B coupled with the hinge panel 214A and the adjacent panels 204B and 204C coupled with the hinge panel 214B are spaced apart from each other a greater longitudinal distance as compared to adjacent panels 204 that are coupled with the hinge connectors 206. The width of the hinge panels 214A and 214B may be substantially less than or equal to a width of the panels 204A-204C. For example, the widths W3 and W4 of the hinge panels 214A and 214B may be between about one-eighth (⅛) to about three-quarters (¾) the width of the panels 204A, 204B and 204C and, more particularly, between about one-quarter (¼) to about one-half (½) the width of the panels 204A, 204B and 204C. The widths W3 and W4 of the hinge panels 214A and 214B may be about 15 millimeters and about 45 millimeters, and more particularly, between about 23 millimeters and about 43 millimeters. In some embodiments, the width W3 of the hinge panel 214A may be substantially equal to the width W4 of the hinge panel 214B. In other embodiments, the width W3 of the hinge panel 214A may be between about one-eighth (⅛) to about three-quarters (¾) the width W4 of the hinge panel 214B. In further embodiments, the width W4 of the hinge panel 214B may be between about one-eighth (⅛) to about three-quarters (¾) the width W3 of the hinge panel 214A. Thus, the hinge panels 214A and 214B provide movable attachment between panels 204A, 204B and 204C while also providing longitudinal spacing between these panels in the direction along the path defined by the track (FIG. 2).

Actuation devices, such as a rocker switch 222, a button switch 224 and, optionally, a display panel 226 may each be mounted on the panel 204B, which is spaced apart from panels 204A and 204C, respectively, by hinge panels 214A and 214B. The configuration and operation of the actuation devices (i.e., the rocker switch 222 and the button switch 224) are substantially similar to those described with respect to FIGS. 3A through 3C.

FIGS. 4B and 4C are top plan views of the portion of the sheet 203A of the movable partition 202 shown in FIG. 2, wherein the rocker switch 222 and the button switch 224 are disposed on (e.g., mounted to) the panel 204B. The rocker switch 222 may be mounted on the panel 204B such that the casing 230 of the rocker switch 222 is disposed on an inner side of the sheet 203A. The switching device 228 of the rocker switch 222 is disposed on an outwardly facing surface of the sheet 203A so that it may be accessed by an individual. The button switch 224 may be mounted on the panel 204B of the sheet 203A by way of the mounting plate 238 such that the plate 234 and the biasing portion 237A of the button 236 protrude from the outwardly facing surface of the sheet 203A where they may be accessed by an individual.

FIG. 4B shows the sheet 203A of the movable partition 202 in an at least partially extended configuration wherein the panels 204A, 204B and 204C are in a generally extended configuration, the panels 204A, 204B and 204C spaced apart and coupled by the hinge panels 214A and 214B, respectively. In the at least partially extended configuration, the plate 234 and biasing portion 237A of the button switch 224, and the switching device 228 of the rocker switch 222, are exposed on the outwardly facing surface of the panel 204B. Thus, the button switch 224 and the rocker switch 222 may be readily accessed by an individual when the movable partition 202 is in an at least partially extended state to cause the movable partition 202 to open if it is closed, or to stop while it is closing, providing access through the barrier formed by the movable partition 202.

FIG. 4C shows the sheet 203A of the movable partition 202 in an at least partially retracted or folded configuration wherein panels 204A, 204B and 204C are laterally spaced apart by a predetermined distance by the hinge panels 214A and 214B and are positioned generally parallel with respect to one another. As shown in FIG. 4C, the voids between panels 204A and 204B, and between panels 204B and 204C, respectively, form a first compartment 242 and a second compartment 244. The plate 234 and the biasing portion 237A of the button switch 224 and the switching device 228 of the rocker switch 222 are housed within the compartment 242. In some embodiments, gap 243 may be present between the plate 234 and the panel 204A to enable access to the plate 234 of the button switch 224 while the sheet 203A is in the at least partially retracted configuration. The casing 230 of the rocker switch 222 and the control portion 237B (shown in broken lines) are housed within the compartment 244. The compartments 242 and 244 provide space within the movable partition 202 while in the folded or retracted state for actuation devices of the movable partition 202, such as the button switch 224, the rocker switch 222 and the display panel 226 (FIG. 2). Furthermore, the compartment 244 may provide space for storage of components of the actuation devices and wiring that do not need to be readily accessed by an individual during operation of the movable partition 202, such as electrical components (i.e., the control portion 237B) of the button 236 and the casing 230 of the rocker switch 222. By disposing the actuation devices of the movable partition 202 within the compartments 242 and 244 during storage of the movable partition 202 (FIG. 2), the actuation devices are protected from damage. Additionally, the actuation devices may not be readily visible and are less susceptible to being tampered with or vandalized in the retracted state.

Figure 5:
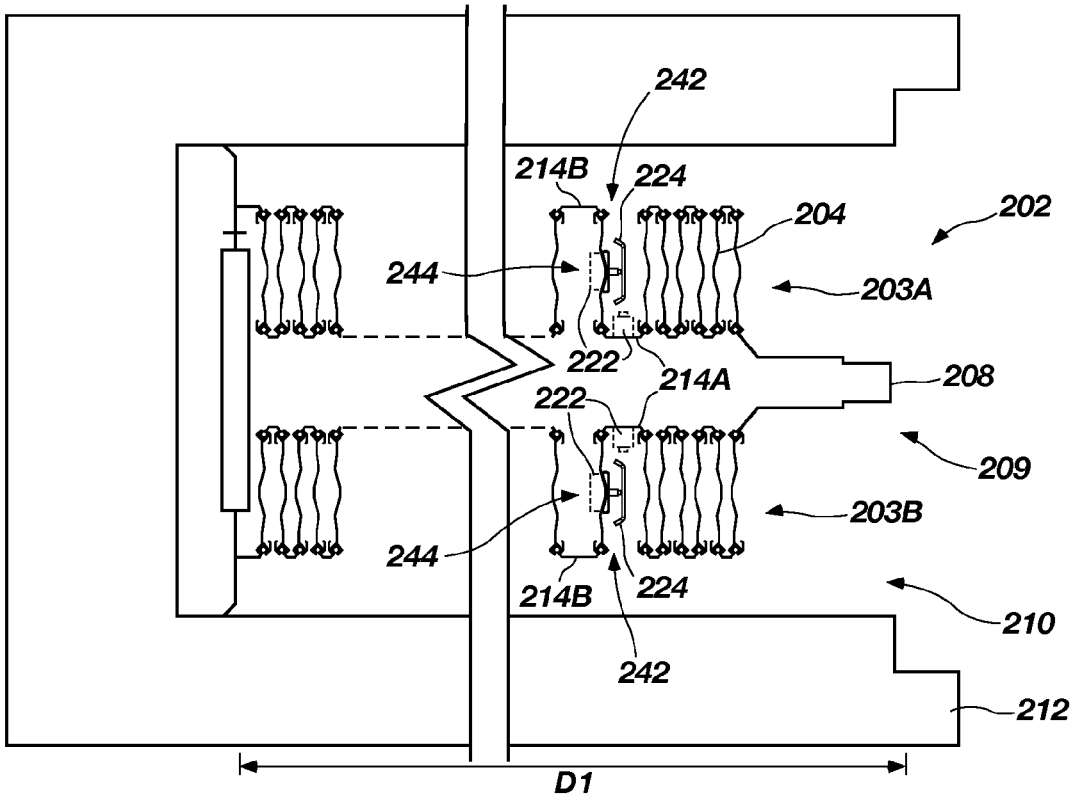
FIG. 5 is a top plan view of a system including the movable partition shown in FIG. 2.

FIG. 5 is a top plan view of the movable partition 202 shown in FIG. 2 in the retracted state. A lead post 208 may be attached to a leading end 209 of the sheets 203A and 203B of panels 204. Although the movable partition 202 is depicted with two hinge panels 214A and 214B, any number of hinge panels may be included to form a desired number of compartments upon retraction of the movable partition 202. The movable partition 202 is depicted with actuation devices (i.e., rocker switches 222 and button switches 224) disposed on both of the sheets 203A and 203B; however, actuation devices may be disposed on only one of the sheets 203A and 203B in additional embodiments.

The hinge panels 214A and 214B respectively define compartments 242 and 244 within the panels 204 of the movable partition 202 and, thus, provide spacing between panels 204 of the movable partition 202 in the retracted state without substantially increasing a depth D1 of the movable partition 202. The hinge panels 214A and 214B of the laterally adjacent sheets 203A and 203B may be longitudinally aligned with one another, respectively. The compartment 244 may provide space for storage of components of the actuation devices and wiring that do not need to be readily accessed by an individual during operation of the movable partition 202, such as electrical components. The compartments 242 and 244 provide space for actuation devices without substantially increasing a depth of a pocket 210 in a wall 212 needed to store the retracted movable partition 202.

While certain embodiments have been described and shown in the accompanying drawings, such embodiments are merely illustrative and not restrictive of the scope of the disclosure, and this disclosure is not limited to the specific constructions and arrangements shown and described, since various other additions and modifications to, and deletions from, the described embodiments will be apparent to one of ordinary skill in the art. Any elements and features disclosed in relation to one embodiment may be combined with any other features and elements of other disclosed embodiments. Thus, the scope of the disclosure is only limited by the literal language, and legal equivalents, of the claims that follow.

What is claimed is:

1. A movable partition system, comprising:
a folding section comprising:
a plurality of interconnected panels; and
at least two hinge panels indirectly interconnecting and spacing apart adjacent panels of the plurality of interconnected panels, the adjacent panels coupled by the at least two hinge panels being spaced from each other a greater longitudinal distance along a direction of movement of the folding section than remaining interconnected panels of the plurality of hinge panels; and
at least one actuation device disposed on at least one of the adjacent panels indirectly interconnected and spaced apart by the at least two hinge panels.

2. The system of claim 1, wherein the plurality of interconnected panels are indirectly interconnected by a plurality of hinges.

3. The system of claim 1, wherein the at least one actuation device comprises at least one of a button switch and a rocker switch.

4. The system of claim 1, further comprising another actuation device mounted on one of the at least two hinge panels.

5. The system of claim 1, further comprising a display panel disposed on at least one of the at least two hinge panels and of the adjacent panels interconnected and spaced apart by the at least two hinge panels.

6. The system of claim 1, wherein the folding section is configured to fold to a retracted state wherein each of the at least two hinge panels and the adjacent panels defines a compartment in the retracted state, the compartment sized and configured to house the at least one actuation device.

7. A movable partition system, comprising:

a movable partition comprising a first partition and a second partition, each of the first and second partitions configured to move between an extended state and a retracted state and comprising:

a first panel;

a second panel adjacent the first panel;

a third panel adjacent the second panel;

a first hinge panel coupling the first panel and the second panel, the first hinge panel having a width sufficient to define a compartment between the first and second panels in the retracted state; and a second hinge panel coupling the second panel and the third panel, the second hinge panel having a width sufficient to form a second compartment between the second and third panels in the retracted state; and at least one actuation device mounted on at least one of the second panel and the first hinge panel of at least one of the first partition and the second partition.

8. The system of claim 7, wherein the first and second hinge panels of the first partition and the second partition are longitudinally aligned with one another.

9. The system of claim 7, wherein the first hinge panel movably connects a lateral end of the first panel to a lateral end of the second panel and the second hinge panel movably connects a lateral end of the third panel to a lateral end of the second panel opposite the lateral end thereof connected to the first hinge panel.

10. The system of claim 7, wherein the at least one actuation device is mounted on the second panel so that a switch thereof is exposed on an outwardly facing surface of the second panel and a control element thereof is disposed on a back side of the second panel between the first and second partition.

11. The system of claim 7, wherein the at least one actuation device comprises at least one of a button switch and a rocker switch.

12. The system of claim 11, wherein the button switch and the rocker switch are housed within at least one of the first and second compartments in the retracted state.

13. The system of claim 7, wherein a width of the first hinge panel is substantially equal to a width of the first compartment and a width of the second hinge panel is substantially equal to a width of the second compartment.

14. A movable partition system, comprising:

a sheet of panels movably connected to one another by a plurality of hinge connectors, the sheet configured to extend to an extended state and to fold in an accordion fashion to a retracted state and comprising:

a plurality of hinge panels, each having a width greater than a width of the hinge connectors and coupling adjacent panels of the sheet of panels, each hinge panel and the adjacent panels coupled thereto defining a compartment within the sheets of the panels while in the retracted state; and at least one actuation device housed within the compartment in the retracted state.

15. The system of claim 14, wherein the plurality of hinge panels comprises:

a first hinge panel coupling a lateral end of a first panel to a lateral end of a second panel; and a second hinge panel coupling a lateral end of the second panel opposite the lateral end connected to the first hinge panel to a lateral end of a third panel.

16. The system of claim 15, wherein the first and second panels are laterally spaced by the first hinge panel and wherein the second and third panels are laterally spaced by the second hinge panel.

17. The system of claim 15, wherein the first hinge panel defines a closed end of a first compartment between the first and second panels in the retracted state and the second hinge panel defines a closed end of a second compartment between the second and third panels in the retracted state.

18. The system of claim 15, wherein the at least one actuation device comprises:

a button switch mounted on the second panel between the first hinge panel and the second hinge panel; and a rocker switch device mounted on at least one of the second panel and the first hinge panel.

19. The system of claim 18, wherein a plate and a biasing element of the button switch are mounted on an outwardly facing surface of the second panel and a control element of the button switch is mounted on a back side of the second panel, opposite the outwardly facing surface.

20. The system of claim 19, wherein a control element of the rocker switch is disposed on the back side of the second panel and a switch of the rocker switch is disposed on the outwardly facing surface.

21. A method of installing a movable partition system, comprising:

forming a movable partition comprising a sheet of panels configured to extend to an extended state and to fold in an accordion fashion to a retracted state, the panels of the sheet coupled to one another at lateral ends thereof;

disposing at least two hinge panels in between adjacent panels of the sheet, the at least two hinge panels indirectly coupling the adjacent panels and providing lateral spacing therebetween; and disposing an actuation device on at least one of the at least two hinge panels and the adjacent panels coupled by the at least two hinge panels, the at least two hinge panels providing lateral spacing between panels of the sheet to define adjacent compartments in the retracted state.

* * * * *